US008864924B2

(12) United States Patent
Coffey et al.

(10) Patent No.: US 8,864,924 B2
(45) Date of Patent: Oct. 21, 2014

(54) SOLID-STATE THERMITE COMPOSITION BASED HEATING DEVICE

(75) Inventors: Brendan Coffey, Austin, TX (US); Donald R. Schropp, Jr., Austin, TX (US); Krzysztof Czeslaw Kwiatkowski, Austin, TX (US)

(73) Assignee: HeatGenie, Inc., Austin, TX (US)

( * ) Notice: Subject to any disclaimer, the term of this patent is extended or adjusted under 35 U.S.C. 154(b) by 1576 days.

(21) Appl. No.: 12/419,917

(22) Filed: Apr. 7, 2009

(65) Prior Publication Data

US 2010/0252022 A1 Oct. 7, 2010

(51) Int. Cl.

| | |
|---|---|
| ***C06B 33/06*** | (2006.01) |
| ***C06B 33/00*** | (2006.01) |
| ***C06B 29/00*** | (2006.01) |
| ***F24J 1/00*** | (2006.01) |
| ***C06B 33/12*** | (2006.01) |

(52) U.S. Cl.
CPC ... *F24J 1/00* (2013.01); *C06B 33/12* (2013.01)
USPC ..... 149/75; 149/37; 149/42

(58) Field of Classification Search
CPC ..... C06B 33/12; C06B 33/00; C06B 33/06; C06B 29/00
USPC ..... 149/75, 37, 42
See application file for complete search history.

(56) References Cited

U.S. PATENT DOCUMENTS

| | | | | |
|---|---|---|---|---|
| 3,198,640 | A * | 8/1965 | Walsh | 106/38.3 |
| 4,658,886 | A | 4/1987 | Carlson et al. | |
| 5,650,590 | A | 7/1997 | Taylor | |
| 5,700,974 | A | 12/1997 | Taylor | |
| 6,328,943 | B1 | 12/2001 | Roling et al. | |
| 6,627,013 | B2 | 9/2003 | Carter | |
| 7,721,556 | B2 | 5/2010 | Guida | |
| 2003/0145752 | A1 | 8/2003 | Carter | |
| 2003/0145924 | A1 | 8/2003 | Carter | |
| 2006/0086097 | A1 | 4/2006 | Guida | |
| 2007/0164253 | A1 | 7/2007 | Iannicelli | |
| 2008/0251063 | A1 | 10/2008 | Palena et al. | |

FOREIGN PATENT DOCUMENTS

| | | | |
|---|---|---|---|
| AT | 443465 | T | 10/2009 |
| AU | 2003-256246 | A1 | 11/2003 |
| AU | 2003-256246 | A8 | 11/2003 |
| AU | 2002-337621 | A1 | 3/2004 |
| AU | 2002-337621 | B2 | 11/2008 |
| BR | 0215860 | A | 7/2005 |
| CA | 2496377 | A1 | 3/2004 |

(Continued)

*Primary Examiner* — Aileen B Felton
(74) *Attorney, Agent, or Firm* — DuBois, Bryant & Campbell, LLP; William D. Wiese

(57) ABSTRACT

A solid state thermite reaction composition is provided comprising a fuel component, an initiating oxidizer, a primary oxidizer, a fluxing agent and a thermal diluent. According to another aspect, a heating device is provided comprising a heating chamber for receiving and storing a substance to be heated having at least two walls, a reaction chamber affixed to a wall of the heating chamber, a solid state thermite reaction composition located within the reaction chamber and an actuatable trigger mechanism affixed to the reaction chamber such that the trigger mechanism is in contact with the reaction composition. According to another aspect, a solid-state thermite reaction activation mechanism is provided comprising a first compound substantially in contact with a thermite reaction fuel, a second compound and a removable barrier located between the first and second compounds preventing any contact between the first and second compounds.

6 Claims, 4 Drawing Sheets

(56) References Cited

FOREIGN PATENT DOCUMENTS

| | | | |
|---|---|---|---|
| CA | 2496377 | C | 9/2009 |
| CN | 1668513 | A | 9/2005 |
| CN | 100503391 | C | 6/2009 |
| DE | 60214443 | D1 | 10/2006 |
| DE | 60214443 | T2 | 3/2007 |
| DE | 602006009419 | D1 | 11/2009 |
| EP | 0764621 | A2 | 3/1997 |
| EP | 0764621 | A3 | 3/1998 |
| EP | 1534607 | A1 | 6/2005 |
| EP | 1534607 | B1 | 8/2006 |
| EP | 1811008 | A2 | 7/2007 |
| EP | 1956950 | A2 | 8/2008 |
| EP | 1956950 | B1 | 9/2009 |
| EP | 1811008 | A3 | 12/2009 |
| ES | 2271336 | T3 | 4/2007 |
| JP | 09-118581 | A | 5/1997 |
| JP | 2002-363544 | A | 12/2002 |
| JP | 2005-537999 | A | 12/2005 |
| JP | 04105162 | B2 | 6/2008 |
| JP | 2009-515785 | A | 4/2009 |
| KR | 10-0877454 | B1 | 1/2009 |
| MX | PA05002375 | A | 9/2005 |
| UA | 79011 | C2 | 5/2007 |
| WO | 03-093402 | A2 | 11/2003 |
| WO | 03-093402 | A3 | 11/2003 |
| WO | 2004-022450 | A1 | 3/2004 |
| WO | 2007-059122 | A1 | 5/2007 |
| WO | 2007-059151 | A2 | 5/2007 |
| WO | 2007-059151 | A3 | 9/2007 |

* cited by examiner

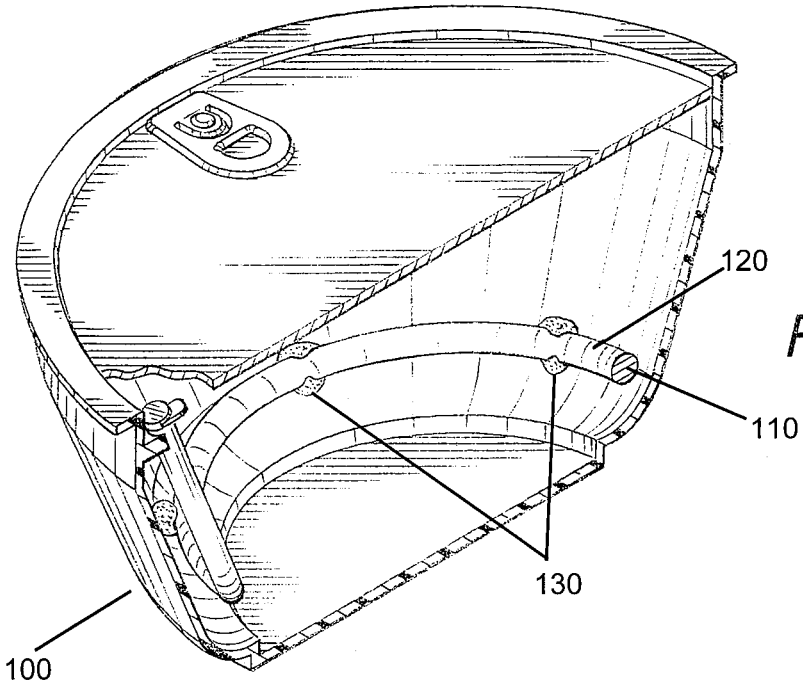
FIG. 1
FIG. 2
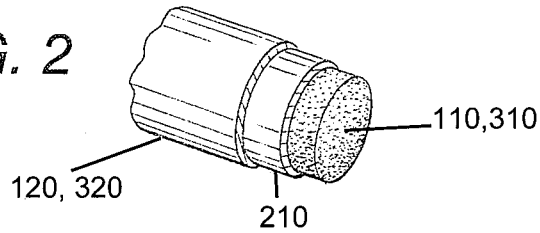
FIG. 3
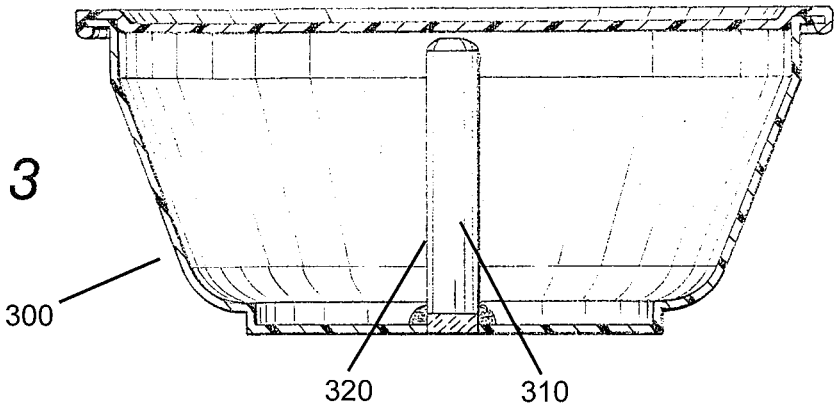

FIG. 4
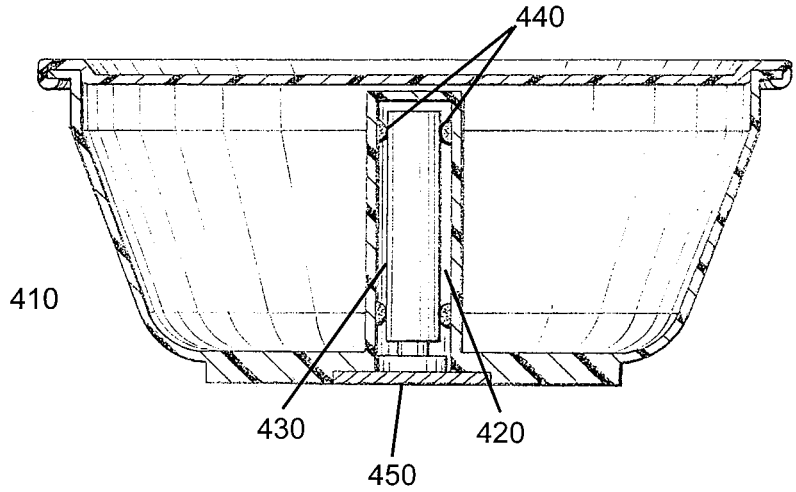
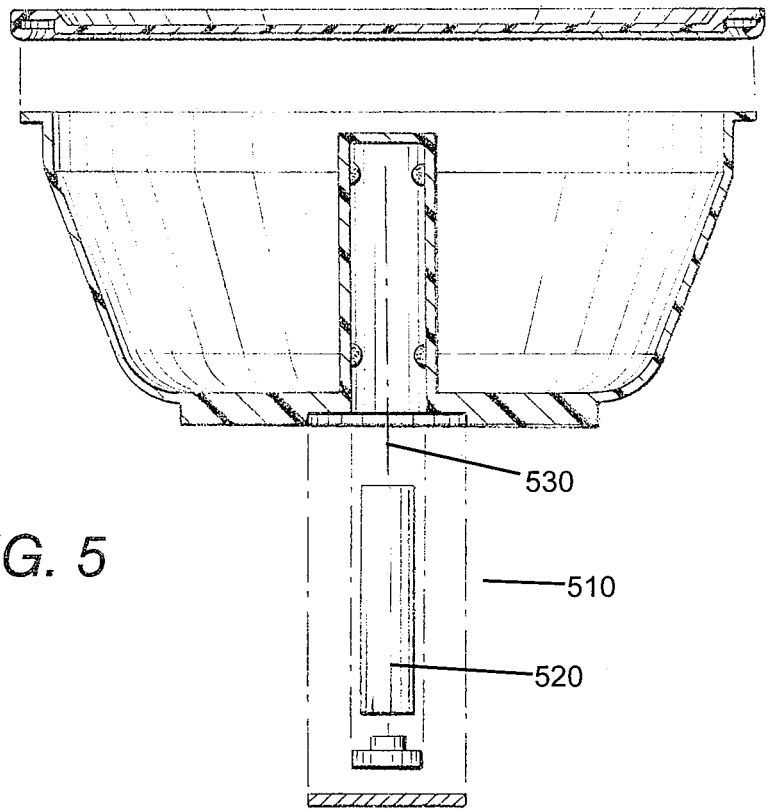
FIG. 5

SOLID-STATE THERMITE COMPOSITION BASED HEATING DEVICE

TECHNICAL FIELD

This disclosure relates to precisely controlled solid state thermite reaction compositions and incorporation of those compositions into an integrated heating device for various applications such as heating of prepared foods or beverages in their containers.

BACKGROUND

Situations arise in which it would be convenient to have a distributed means of providing heat in circumstances where heating appliances are not available. For example, producers of prepared foods have indicated that there could be significant market potential for self-heating food packaging (SHFP) systems that could heat prepared foods in their containers to serving temperature, simply, safely, and efficiently.

For a mass consumer SHFP product, safety is paramount and should be inherent; preferably there should be no extreme temperatures, no fire, no smoke or fumes under anticipated use and abuse conditions. Practical considerations mandate that any system be reasonably compact and lightweight with respect to the food to be heated. Thus, the system should have a good specific energy and high efficiency. The system must also be capable of extended storage without significant loss of function or accidental activation of the heater. There should be some simple means of activating the heating component of the system, after which the required heat load should be delivered efficiently within a specified time period, perhaps just a few minutes. Operation must be very reliable with low failure rates in millions of units of production. For a single use food application, material components should be food-safe, low-cost, environmentally friendly and recyclable.

The only SHFP technology currently in the consumer market uses an onboard system for mixing separated compartments of quicklime and water, yielding an exothermic heat of solution. These products are bulky (literally doubling package size and weight), complex, unreliable, costly, and have achieved very low market penetration. There have also been reported instances of the heater solution leaking and coming into contact with food or consumers.

An exothermic reaction in which the component reactants could be premixed yet be inert until such time as the user initiates the reaction would be beneficial in terms of providing for a simpler, more compact, and low cost package design. A solid state reaction system could offer advantage over wet chemical systems since solid systems will be less prone to spill or leak.

Thermites are a class of exothermic solid-state reactions in which a metal fuel reacts with an oxide to form the more thermodynamically stable metal oxide and the elemental form of the original oxide. Thermites are formulated as a mechanical mix of the reactant powders in the desired stoichiometric ratio. The powders may be compressed into a unitary mass. These compact reactions generate substantial heat, with system temperatures that can reach several thousand degrees, often high enough to melt one or more of the reagents involved in the reaction. However, thermite reactions typically require a very high activation energy (e.g., welding thermites [Al/$FeO_x$] are ignited with a burning magnesium ribbon). Thus, a thermite reagent composition can be formulated to be quite stable to prevent inadvertent initiation due to electrostatic shock or mechanical impact. This generally inert character is an advantage in storage and transportation.

The most widely known thermite system is the Al/$FeO_x$ system described in Table 1. Once initiated, this system reacts virtually instantaneously to generate molten iron and is in fact used for welding rail lines. The only other significant known applications of thermites are in pyrotechnics and military weapons technologies. "A Survey of Combustible Metals, Thermites, and Intermetallics for Pyrotechnic Applications," S. H. Fischer, M. C. Grubelich, *Proc. Of* 32$^{nd}$ *AIAA/ASME/SAE/ASEE Joint Propulsion Conference* (1996) and "Thermite Reactions: their utilization in the synthesis and processing of materials," L. L. Wang, Z. A. Munir, Y. M. Maximov, *Journal of Material Science* 28(14), 3693-3708 (1993) provide useful surveys of various classes of solid state reactions including thermites.

TABLE 1

Characteristics of FeOx/Al and SiO2/Al Thermite Reactions

| Reaction | Density (g cm$^{-3}$) | Heat of reaction (kJ g$^{-1}$) | Adiabatic Reaction Temperature (K) | State of Products | Gas production (moles of gas per 100 g) |
|---|---|---|---|---|---|
| $2Al + Fe_2O_3 \rightarrow 2Fe + Al_2O_3$ | 4.175 | 3.95 | 3135 (2862° C.) | molten $Al_2O_3$ slag Fe (liq./gas) | 0.1404 |
| $8Al + 3Fe_3O_4 \rightarrow 9Fe + 4Al_2O_3$ | 4.264 | 3.67 | 3135 (2862° C.) | Molten $Al_2O_3$ slag Fe (liq./gas) | 0.0549 |
| $4Al + 3SiO_2 \rightarrow 3Si + 2Al_2O_3$ | 2.668 | 2.15 | 1889 (1616° C.) | solid $Al_2O_3$ Si (liq.) | 0 |

Since thermite reactions are generally vigorous with intense heat, they have not yet been successfully adapted for moderate-temperature consumer applications. Therefore, it would be highly beneficial to harness the energy release from a kinetically moderated thermite reaction thus transforming a reaction with generally pyrotechnic character to a precisely controlled power source for thermal energy and to then integrate that thermal energy into a heating device for consumer applications.

SUMMARY

A solid state thermite reaction composition is provided comprising a fuel component, a primary oxidizer, one or more initiating oxidizers and a thermal diluent. The composition can be further comprised of a fluxing agent. The composition can also further be comprised of a high energy oxidizer.

According to another aspect, a heating device is provided comprising a heating chamber for receiving and storing a substance to be heated having at least two walls, a reaction chamber affixed to a wall of the heating chamber, a solid state thermite reaction composition located within the reaction chamber and an actuatable trigger mechanism affixed to the reaction chamber such that the trigger mechanism is in contact with the reaction composition. The reaction composition is inert until the trigger mechanism is actuated and wherein the reaction composition is isolated from the substance to be heated.

According to another aspect, a solid-state thermite reaction activation mechanism is provided comprising a first compound substantially in contact with a thermite reaction fuel, a second compound and a removable barrier located between the first and second compounds preventing any contact between the first and second compounds. When the barrier is removed, the first and second compounds contact one another and generate heat sufficient to initiate a thermite reaction using the thermite reaction fuel. Although not specifically described herein, other aspects will be apparent to those of ordinary skill in the art.

BRIEF DESCRIPTION OF THE DRAWINGS

To understand the present invention, it will now be described by way of example, with reference to the accompanying drawings in which:

FIG. 1 is a perspective cross-sectional view of an illustrative embodiment of a food packaging application with an integrated solid-state thermite heating element;

FIG. 2 is a perspective cross-sectional view of the heating element depicted in FIG. 1;

FIG. 3 is a side cross-sectional view of another illustrative embodiment of a food packaging application with an integrated solid-state thermite heating element;

FIG. 4 is a side cross-sectional view of an illustrative embodiment of a re-useable bowl with a port to removably insert a solid-state thermite heating element;

FIG. 5 is a side cross-sectional view of the embodiment of FIG. 4 with a re-useable activation mechanism removably attached;

DETAILED DESCRIPTION OF EXEMPLARY EMBODIMENTS

Figure 6:
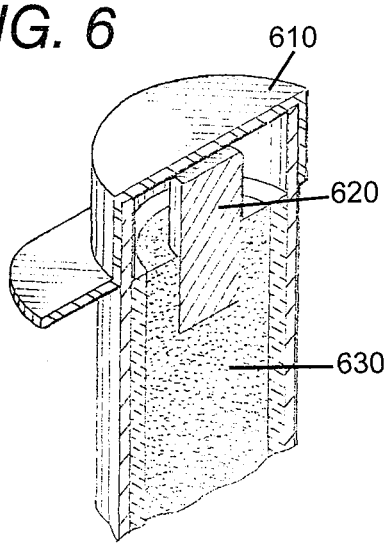
FIG. 6 is a perspective cross-sectional view of a solid-state thermite activation mechanism with a tear-off seal.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Food safety and cost are two primary considerations in the selection of potential materials for use in the illustrative embodiments described herein. The $Al/FeO_x$ and $Al/SiO_2$ thermites described in Table 1 involve only abundant, low-cost, food-safe materials and are therefore in this regard good candidates for SHFP. However, those of ordinary skill in the art will understand that many different materials could be selected without departing from the novel scope of the present invention.

Table 1 compares various characteristics of $Al/FeO_x$ and $Al/SiO_2$ thermite systems. In both cases aluminum is the fuel, with either $FeO_x$ or $SiO_2$ as oxidizer. However the reaction character of the two systems are distinctly different. The high heat of reaction (3.8 kJ $g^{-1}$) of the $Al/FeO_x$ thermite leads to an adiabatic reaction temperature of over 3000 K (well above the melting point of both metals: $T_{M,Fe}$=1809 K, $T_{M,Al}$=933 K), with excess heat generating gases that can spew molten reaction product. The heat of reaction for $Al/SiO_2$ thermite is somewhat lower (2.15 kJ $g^{-1}$) leading to an adiabatic reaction temperature of only 1889 K. This temperature is insufficient to melt the alumina slag formed during reaction. This slag acts as a thickening barrier to mass transfer in this type of system, and thus, thermal losses at the reaction front can quench the $Al/SiO_2$ thermite reaction.

The rate-limiting step in thermite reactions is typically diffusion of material to the reaction zone. Accordingly, heat transfer and mass transfer are closely coupled in determining reaction rate. Thermite kinetics are typically modeled as a combustion system in which a solid flame front moves through preheat, reaction and quench zones. For reaction self-propagation to occur, the heat generated in the reaction zone must trigger reaction ahead of the wave front. The parameter used to quantify reaction rate of thermites is combustion wave speed. These can range anywhere from approximately 1 m $s^{-1}$ for conventional thermites to greater than 1000 m $s^{-1}$ for superthermites based on nanoscale powdered reactants.

While reasonably exothermic, the $Al/SiO_2$ system is inherently both non-detonative and self-extinguishing. Based on this more controlled reaction character, this system comprises the foundation of the moderated thermite composition of the embodiments of the present invention described herein. In one embodiment the foundational solid state chemistry is modulated via a combination of physical and chemical reaction modifiers to prepare $Al/SiO_2$ thermite fuel formulations that are inherently self-regulating at an optimal bounded temperature and give high utilization of the chemical energy content of the reaction materials at the requisite rate of heating.

Another aspect of these embodiments is maximization of energy content in the solid thermite composition. "Mixed" thermites can be prepared, for example using a combination of oxidizers, and, as shown in Table 1, substituting any portion of the $SiO_2$ oxidizer with $FeO_x$ to create a ternary system, which can beneficially increase the specific energy content of the system from approximately 2 to 4 kJ $g^{-1}$ depending on $FeO_x$ content. Aluminum, $SiO_2$, and iron oxides are readily available in various commercial powder grades with food grade purity.

Factors that can be altered to adjust the reaction rate and combustion temperature of thermite systems include: particle size of reactants, composition, diluent (inert) additives, pre-combustion density, ambient pressure and temperature and physical and chemical stability of reactants.

Because mass diffusion is the rate controlling step for thermites and diffusion-controlled reactions are inherently slower than temperature dependent chemical kinetics, increasing the diffusion coefficient or reducing the diffusion length between fuel and oxidizer species within an energetic composite can be used to accelerate the reaction rate. Particle shape can be highly influential. Spherical particles can be undesirable if they are too reactive and result in excessive burn rates. Thin and flat-shaped particles can be more ideal for moderate temperature reactions. For efficient thermite fuel utilization, the solid-state reaction must be self-sustaining throughout its volume and there should not be extensive un-reacted regions. Those of ordinary skill in the art will understand that the degree and intimacy of mixing between the silica, aluminum, and additive constituents can be altered to satisfy a myriad of desired outcome parameters without departing from the novel scope of the present invention.

In a preferred embodiment of an $Al/SiO_2$ thermite fuel formulation as shown in Table 2 below, the thermite fuel is an aluminum flake. In order to achieve an appropriate balance of reactive surface area and relatively low thermal conductivity to reduce combustion rate, a portion of the silica used is fumed silica, which is in fact an agglomerated nanoparticulate that is easily dispersed into mixtures. Certain materials can act as a "coolant" to lower the burning temperature of the mixture and/or slow down the reaction rate. Other additives can act as binders or stabilizers to regulate mass and heat transfer. Accordingly, in a particular embodiment, a nanoscale clay material is used as a thermal buffer to moderate temperature. Other materials may be used as well.

In order to render self-sustaining character to the $Al/SiO_2$ system while operating at lower temperatures, an accelerant is incorporated to reduce the activation energy for the reaction or enable a lower energy reaction path. For example, as shown in Table 2, potassium chlorate, a strong oxidizer is used as an accelerant. Those of ordinary skill in the art will understand that there are many other possible chemical accelerants that could be incorporated without departing from the novel scope of the present invention. Further, the high boiling point, inert salt calcium fluoride is provided as a fluxing agent to increase the fluidity of the reacting system and thereby facilitate mass transport.

TABLE 2

Compositions in Weight Percent for Examples

| Component | Function | Example I (BC03A04) | Example II (BC12A02) |
|---|---|---|---|
| Flaked Aluminum powder (Toyal America 5621) | Fuel component | 17.9% | 17.3% |
| $KClO_3$ (Sigma-Aldrich 31247) | Initiating oxidizer | 14.3% | 13.8% |
| $SiO_2$ −325 mesh (Sigma-Aldrich 342890) | Oxidizer, dense form | 17.9% | 13.0% |
| Fumed silica (Sigma-S5130) | Oxidizer, high surface area form | 3.5% | 3.5% |
| $CaF_2$ (Sigma-Aldrich 31247) | Fluxing agent | 10.7% | 10.4% |
| Bentonite nanoclay (Aldrich 682659) | Thermal Diluent | 35.7% | 34.3% |
| $Fe_2O_3$ <5 micron (Sigma-Aldrich 31247) | High energy oxidizer | 0% | 7.7% |

The exemplary thermite fuel compositions described above were tested to determine their specific energy and reaction rate as follows:

EXAMPLE I

Specific Energy and Reaction Rate Determination on a Moderated Al/SiO2 Thermite—Initiated by Hot Wire An approximately 30 g batch of the formulation in column 3 of Table 2 is prepared using the following steps. The powdered components are all first sieved through a 60-mesh screen and weighed in correct proportions into a mill jar. They are mixed in the jar by tumbling on a roll mill for 30 minutes.

Figure 10:
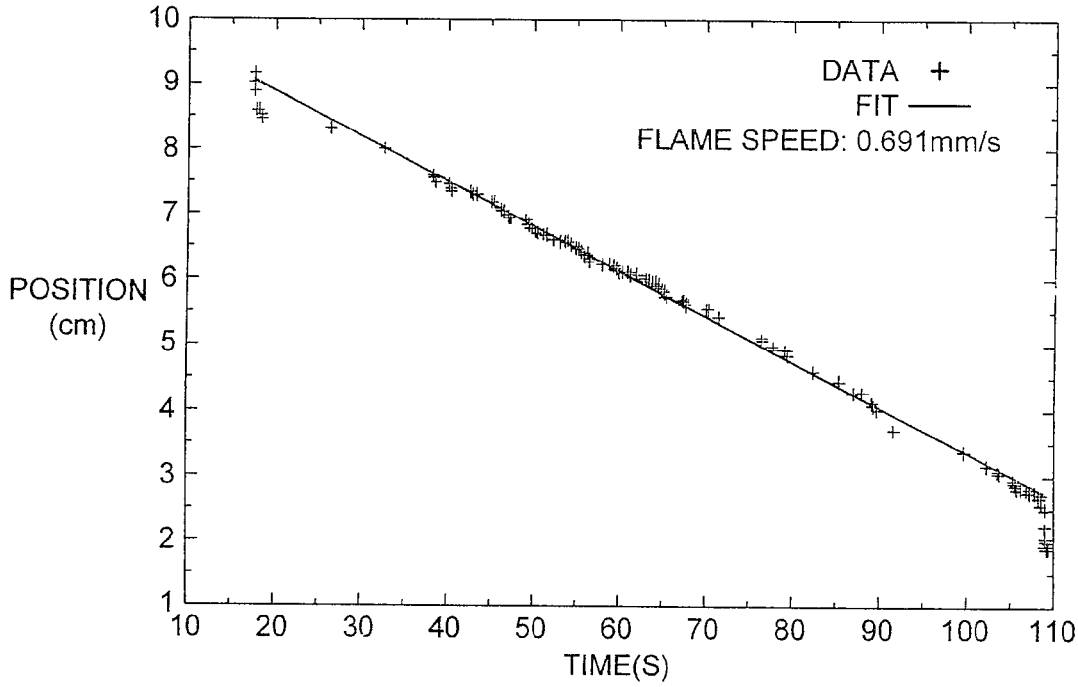
FIG. 10 is a graphical depiction of a least squares fit of thermite reaction flame position versus time data.

As discussed previously, the rate of reaction and hence heat generation or power is a key metric for an energetic material in consumer heating applications. Kinetic measurements were made on the Example I material by flame tube experiments in which the energetic material is placed in a Pyrex tube and initiated with a hot wire. A video of the reaction is made and then the position data of the reaction front versus time are least square analyzed to extract reaction propagation velocity. FIG. 10 shows the reaction propagation velocity for the Example I material to be 0.691 mm $s^{-1}$. This low combustion rate is significantly below that previously reported for conventional thermite reactions and allows efficient calorimetric heat transfer to take place.

Figure 11:
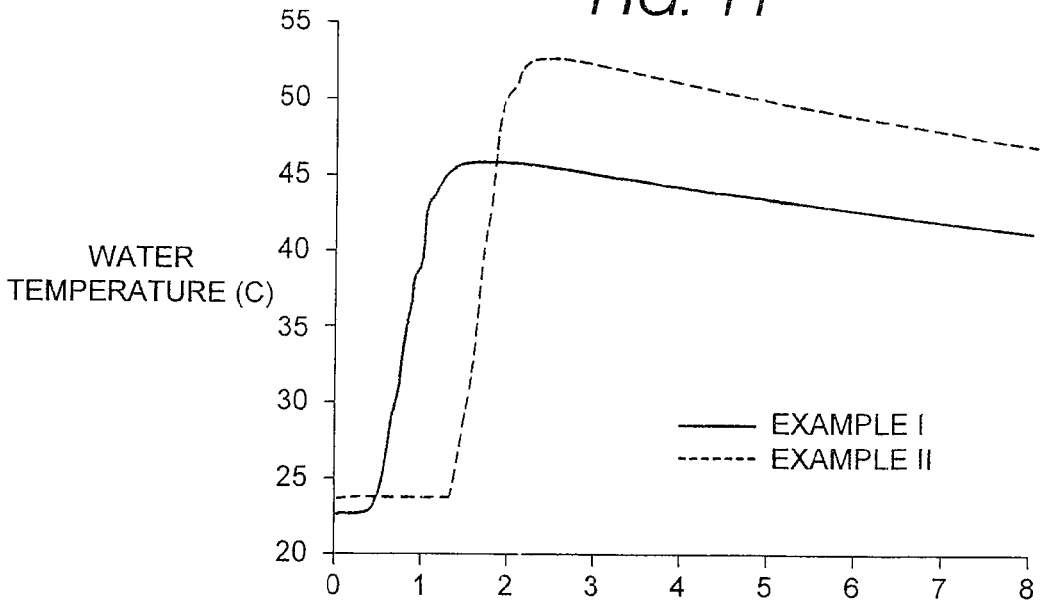
FIG. 11 is a graphical depiction of calorimetry data of solid-state thermite reactions.

Calorimetric data was measured on a sample prepared by packing approximately 7 g of the powder mix into an open top cylindrical steel can (14 mm diameter×50.5 mm high). The filled can is held immersed in a stirred beaker containing approximately 120 g of water. A small nichrome wire heating element connected to a current source is placed in contact with the upper surface of the packed powder. Current is passed momentarily to initiate the mix and then switched off. The temperature of the water vs. time is recorded, and the maximum temperature increase is used to calculate the thermal energy transferred to the water. The curve labeled Example I on FIG. 11 shows calorimetric time vs. temperature data on the Example I formulation. With the Example I formulation, it takes less than 2 minutes for the water to reach its peak temperature and deliver an energy content of 1.61 kJ $g^{-1}$.

EXAMPLE II

Specific Energy Determination on a Moderated Al/SiO2 Thermite Containing $Fe_2O_3$—Initiated by Hot Wire Example II is prepared in a similar manner and tested as Example I except that some stoichiometric fraction of the $SiO_2$ in the formulation is replaced by $Fe_2O_3$ to yield the formulation given in Column 4 of Table 2. The curve labeled Example II on FIG. 11 shows calorimetric time vs. temperature data on the Example II formulation. The greater specific oxidizing power of the $Fe_2O_3$ substituent is evidenced by a higher peak temperature of the water. This corresponds to a transferred energy content of 1.76 kJ $g^{-1}$.

Another embodiment of the present invention is the inclusion of a means for activating a solid-fuel thermite composition. The solid fuel should not be prone to inadvertent activation, yet a simple means of activating the reactive material in the heater at the desired time of use is beneficial.

Figure 9:
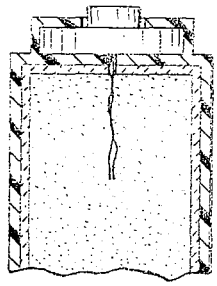
FIG. 9 is a side cross-sectional view of a solid-state thermite activation mechanism with a peizoelectric spark ignitor.

In some embodiments, a more complex and costly activation device that is re-useable would couple to disposable heater elements for activation. For example, as shown in FIGS. 4 and 5, a re-useable container is provided with a re-useable activating device such as a battery powered hot wire or a piezoelectric spark ignitor, as shown in FIG. 9.

Referring to FIG. 4, a heating bowl 410 is provided with a port 420 to receive heating elements 430 containing a solid-state thermite fuel composition. The heating element 430 is held in place by holding tabs or standoffs 440. An activation device port 450 is provided on the bottom of the bowl to receive and temporarily attach a thermite activation device. The activation device could be a simple battery and wire device 510 as shown in FIG. 5. The battery 520 is connected to a wire 530 that can be extended through the activation device port 450 into the thermite fuel composition within the heating element 430. The battery can be used to send enough current down the wire to initiate a thermite reaction using the thermite fuel composition. In addition, the activation device could be a piezoelectric spark ignitor as shown in FIG. 9. Those of ordinary skill in the art will understand that many types of activation devices can be employed without departing from the novel scope of the present invention.

Figure 7:
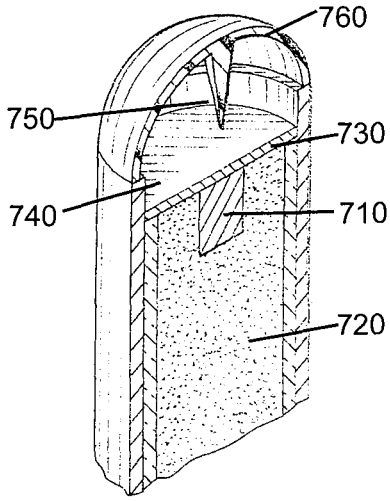
FIG. 7 is a perspective cross-sectional view of a solid-state thermite activation mechanism with a foil barrier and foil piercing element.
Figure 8:
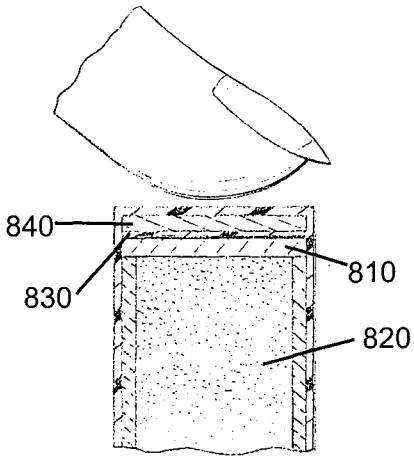
FIG. 8 is a side cross-sectional view of a solid-state thermite activation mechanism with a membrane coated with activation reagents on both sides.

In a particular embodiment that enables the greatest ease of use, a simple, low-cost, small (or even miniature) activation device as a built-in component of the heating device is provided. This embodiment is particularly useful in the disposable food packaging context. For example, as shown in FIGS. 6, 7 and 8, the activation device could be comprised of minute quantities of an exothermic A/B chemical couple separated by a partition. When the partition is breached mechanically by a simple action of the user, the reactive A/B components mix into contact with each other as well as with the bulk solid thermite fuel composition. Reaction of the A/B components generates a highly localized hot spot in contact with the fuel composition, thereby initiating its controlled combustion.

While those of ordinary skill in the art will understand that there are many exothermic couples that can be used, FIGS. 6, 7 and 8 show three designs that incorporate reagents which produce sufficient heat to activate thermite reactions. FIG. 6 shows a pyrophoric iron/air couple where the removal of an internal seal 610 exposes a small mass of pyrophoric iron 620, which is in contact with a solid thermite fuel composition 630, to the surrounding atmosphere. The pyrophoric iron reacts with the air to generate the requisite heat to initiate the thermite reaction.

A potassium permanganate/glycerin couple, as shown in FIG. 7, is easily prepared, low-cost and food safe while reliably generating very high temperatures with minute quantities of reagents. FIG. 7 shows an amount of potassium permanganate 710 placed directly onto the thermite fuel composition 720. An aluminum foil barrier 730 is placed over the potassium permanganate 710 and glycerin 740 is placed onto the foil. A cover 760 made of a malleable material with an integrated piercing member 750 is placed over the entire system. A user can then activate the mechanism by pressing down on the cover 760 thus pushing the piercing member 750 through the foil barrier 730, allowing the potassium permanganate 710 and glycerin 740 to mix and generate enough heat to initiate the thermite reaction.

This embodiment is capable of being produced in high volume based on a multi-laminate paper making process in which a thin septum layer is interposed between sheets coated with each reactant as shown in FIG. 8. As shown in FIG. 8, the potassium permanganate 810 and glycerin 840 are disposed on either side of a thin membrane 830. A user can rupture the membrane 830 by applying pressure thus allowing the potassium permanganate 810 and glycerin 840 to mix and contact the thermite fuel composition 820, thus initiating the desired thermite reaction.

A still further aspect of the present invention is integration of a heating element comprised of a thermite fuel composition and an activation mechanism into the packaging of a food product to be heated by a consumer. An appropriate design of package can be used in conjunction with the moderated composite fuel formulation to provide for ease of use and additional consumer safety. The solid-state fuel can be integrated into a package in a way that provides for efficient transfer of the heat generated to the material to be heated. To illustrate this aspect of the invention, several illustrative embodiments describing designs for incorporating solid fuel compositions into self-heating food packaging follow.

FIGS. 1 and 3 show heater component designs that are suited to heating foods with a high fluid content, such as canned soups or beverages. In FIG. 1, the fuel composite 110 is packed into a metal tube 120 that is formed into the shape of a complete or partial annular ring to provide a heating surface near the bottom of the container 100 while at least one end of the tube is located near the top of the container to allow access for user activation of the device. In the alternative design of FIG. 3 the fuel composite 310 is packed into a cylindrical metal can 320 which is then affixed to the bottom of the container 300. However, those of ordinary skill in the art will understand that a myriad of heater component shapes can be used without departing from the novel scope of the present invention.

In both designs, the thin metal wall enclosing the fuel provides excellent heat transfer to the surrounding fluid and the simple constructions are amenable to low cost methods of manufacture. As shown in FIG. 2, the tube 120 or cylinder 320 can be lined with a ceramic layer 210 to provide more efficient heat transfer through the metal wall. Various means can be provided for closing the open ends of the packed cylinders so that the fuel materials will not come into direct contact with the food. The packed tubing may be held in place by stand-off mechanical contacts 130, such as for example welded tabs to the interior of the container, so that heat transfers efficiently to the surrounding fluid and heat losses to the exterior food container wall are minimized. The heater elements can be offset from the center in order to facilitate filling, stirring, and spooning material from the container. Those of ordinary skill in the art will understand that numerous methods for attaching or integrating the heating component into the packaging structure are available without departing from the novel scope of the present invention.

Increased weight and volume of packaging relative to the net food content translates to higher shipping costs and shelf space requirements. Therefore, in order to keep packaging overhead low, a compact SHFP heater device is preferred. However, a compact geometry means less surface area is available for heat transfer, which can be an important consideration in cases where the food to be heated is not readily stirred to provide convective heat transfer. Conductive heat transfer from a small heater to a larger mass of solid or non-stirrable food material will provide inefficient and uneven heating.

In order to overcome these limitations, the heater element of this invention may be implemented so that the heat it generates raises steam that distributes throughout the package interior and transfers sensible and latent heat (via condensation) to the food. The principle of using a chemical reaction to raise steam for heat transfer is efficiently used in the "flameless ration heaters" (FRH) used by the US Army to heat the "meal ready to eat" (MRE) field ration.

However, the FRH is a wet system based on mixing magnesium metal powder with water and is not well suited to widespread consumer use, whereas in the present invention, the water to be vaporized is not a component of the dry reaction mixture. Rather a small quantity of water is maintained in contact with the outer surface of the heater. For example, the cylindrical heater design of FIG. 3 could be wrapped in a dampened wicking material or located in a small condensate sump in the base of the package. The combustion characteristics of the heater are designed so that in operation, the exterior surface of the heater maintains a temperature sufficient to vaporize water to steam.

Applications of the present invention are not limited to the SHFP applications described above. A heating component in accordance with the present invention could be incorporated into a wide array of applications where heating would be desirable such as camping equipment as noted above or gloves for skiiers or mountain climbers.

Any process descriptions or blocks in figures represented in the figures should be understood as representing modules, segments, or portions of code which include one or more executable instructions for implementing specific logical functions or steps in the process, and alternate implementations are included within the scope of the embodiments of the present invention in which functions may be executed out of order from that shown or discussed, including substantially concurrently or in reverse order, depending on the functionality involved, as would be understood by those having ordinary skill in the art.

While the specific embodiments have been illustrated and described, numerous modifications come to mind without significantly departing from the spirit of the invention, and the scope of protection is only limited by the scope of the accompanying claims.

What is claimed is:

1. A solid state thermite reaction composition comprising:
a fuel component;
an initiating oxidizer;
a primary oxidizer;
a fluxing agent; and
a thermal diluent, wherein the primary oxidizer comprises a dense form oxidizer and a high surface area oxidizer.

2. A solid state thermite reaction composition comprising:
a fuel component;
an initiating oxidizer;
a primary oxidizer;
a fluxing agent; and
a thermal diluent, wherein the primary oxidizer comprises a dense form oxidizer and a high surface area oxidizer, and wherein the dense form oxidizer is silicon dioxide.

3. A solid state thermite reaction composition comprising:
a fuel component;
an initiating oxidizer;
a primary oxidizer;
a fluxing agent; and
a thermal diluent, wherein the primary oxidizer comprises a dense form oxidizer and a high surface area oxidizer, and wherein the high surface area oxidizer is fumed silica.

4. A solid state thermite reaction composition comprising:
a fuel component;
an initiating oxidizer;
a primary oxidizer;
a fluxing agent; and
a thermal diluent, wherein the primary oxidizer comprises a dense form oxidizer and a high surface area oxidizer, and wherein the dense form oxidizer is between about 12.5 and 18 percent by weight of the composition.

5. A solid state thermite reaction composition comprising:
a fuel component;
an initiating oxidizer;
a primary oxidizer;
a fluxing agent; and
a thermal diluent, wherein the primary oxidizer comprises a dense form oxidizer and a high surface area oxidizer, and wherein the high surface area oxidizer is between about 3 and 4 percent by weight of the composition.

6. A solid state thermite reaction composition comprising:
a fuel component;
an initiating oxidizer;
a primary oxidizer;
a fluxing agent;
a thermal diluent; and,
a high energy oxidizer, wherein the high energy oxidizer is between about 0 and 8 percent by weight of the composition.

* * * * *